US005657807A

United States Patent [19]

Hsu

[11] Patent Number: 5,657,807

[45] Date of Patent: Aug. 19, 1997

[54] OPERATING STRUCTURE FOR A VERTICAL BLIND

[75] Inventor: Peyson Hsu, Changhua Hsien, Taiwan

[73] Assignee: Ching Feng Blinds Ind., Co., Ltd., Changhua Hsien, Taiwan

[21] Appl. No.: 593,047

[22] Filed: Jan. 29, 1996

[51] Int. Cl.[6] ..... E06B 9/36

[52] U.S. Cl. ..... 160/178.1; 160/173; 160/177; 16/122

[58] Field of Search ..... 164/168.1 V, 173 V, 164/174 V, 176.1 V, 177 V, 178.1 V, 900; 16/122

[56] References Cited

U.S. PATENT DOCUMENTS

| | | | |
|---|---|---|---|
| 4,291,738 | 9/1981 | Grenga et al. | 160/176.1 V |
| 4,844,139 | 7/1989 | John | 160/168.1 V |
| 4,936,369 | 6/1990 | Darner | 160/176.1 V |
| 5,038,843 | 8/1991 | Sommerfeld | 160/168.1 V |
| 5,095,966 | 3/1992 | Rogers | 160/168.1 V |
| 5,103,889 | 4/1992 | Ford | 160/177 V |

*Primary Examiner*—Blair Johnson

*Attorney, Agent, or Firm*—Browdy and Neimark

[57] ABSTRACT

An operating structure for a vertical blind, including an operative pulley seat, a guide cord, a shaft wheel, a pressing wheel, a hollow pull rod, a stepped fixing block, a stopper block, a rotary bar and a distance-adjusting strip. A pair of shaft wheel holes and a pair of pressing wheel holes are respectively disposed on two sides of the operative pulley seat. Two corner holes are formed on two corners contained by front side and bottom side of the operative pulley seat. The shaft wheel is formed with spaced axial frictional ribs on its surface and a central rotary bar hole. The rotary bar has a shape corresponding to that of the rotary shaft hole and is passed therethrough. The pressing wheel has a large diameter middle section and two small diameter end sections. The pull rod is a hollow cylindrical column with a certain length. The stepped fixing block has a small diameter upper section and a large diameter lower section. Two through holes extend from top face of the upper section to bottom face of the lower section. The stopper block is a hollow trapezoidal block having a close top end formed with a cord hole and an open bottom end. The slats of the blind can be easily collected without being damaged even in the case that the slats are not face-to-face positioned. In addition, the angle of the slats can be easily adjusted to open or close the blind.

1 Claim, 6 Drawing Sheets

OPERATING STRUCTURE FOR A VERTICAL BLIND

BACKGROUND OF THE INVENTION

1. Technical Field of the Invention

The present invention relates to an operating structure for a vertical blind, in which the slats of the blind can be easily collected without being damaged even in the case that the slats are not face-to-face positioned. In addition, the angle of the slats can be easily adjusted to open or close the blind.

2. Prior Art

FIG. 1 shows a conventional operating structure for a vertical blind, which includes an operative pulley seat 1, an adjustment bar 4, a hollow rotary rod 6 and a distance adjusting strip 7. An ohm set 2 is disposed in the pulley seat 1 and a hanging hook 3 downward extends from the ohm set 2 to the lower side of the pulley seat 1. A ring member 5 is disposed on the top end of the adjustment bar 4.

Referring to FIG. 2, the hollow rotary rod 6 is passed through the rotary rod holes formed on two sides of the ohm set 2 and the distance adjusting strip 7 is fitted into the distance adjusting slots formed on two sides of the pulley seat 1. The ring member 5 of the adjustment bar 4 is hung on the hanging hook 3 under the pulley seat 1. The hollow rotary rod 6 is further passed through the rotary rod holes of the ohm sets 2 of all other pulley seats 1. A slat 9 is clipped by a clip member 8 of each ohm set 2. Two ends of the hollow rotary rod 6 are rotatably secured at two ends of an upper beam 9'. When rotating the slats 9, the adjustment bar 4 is first rotated. At this time, the ring member 5 of the adjustment bar 4 rotarily drives the hanging hook 3 so as to rotate the ohm set 2. In turn, the hollow rotary rod 6 is rotated to rotate the slats 9 by a desired angle. When collecting the slats 9, the slats 9 are first rotated to a position normal to the window by the adjustment bar 4 and then the adjustment bar 4 is pushed or pulled to move the pulley seat 1 so as to push other pulley seats 1 in a collecting direction for collecting the slats 9. When spreading the slats 9, the adjustment bar 4 is reversely pushed or pulled.

Three shortcomings exist in the above conventional arrangement as follows:

1. When collecting the slats 9, the slats 9 must be first rotated to a face-to-face position normal to the window by means of the adjustment bar 4 and then the adjustment bar 4 is pushed or pulled in a collecting direction in order to collect the slats 9. This procedure is quite troublesome.
2. When collected, in case the slats 9 are not in the face-to-face position and are positioned side by side as shown by phantom lines of FIG. 2, a slat may be inserted into the clip member 8 of an adjacent pulley seat to affect the collecting operation or be damaged.
3. A user can hardly judge in which direction the adjustment bar 4 should be rotated in order to open or close the blind. The adjustment bar 4 is often properly rotated after an incorrect operation.

SUMMARY OF THE INVENTION

It is therefore a primary object of the present invention to provide an operating structure for a vertical blind, in which the slats can be collected by means of holding the hollow pull rod and pulling the same in a collecting direction, so that the slats are automatically rotated to a face-to-face position and collected.

It is a further object of the present invention to provide the above operating structure in which when collected, the slats of the blind are automatically rotated to a face-to-face position so as to avoid a slat being inserted into a clip member of an adjacent pulley seat affecting the collecting operation or damaging the slat.

It is still a further object of the present invention to provide the above operating structure in which the angle of the slats can be easily and quickly adjusted to open or close the blind by means of pulling the hollow pull rod or pulling the stopper block.

The present invention can be best understood through the following description and accompanying drawings, wherein:

DETAILED DESCRIPTION OF THE PREFERRED EMBODIMENT

Figure 1:
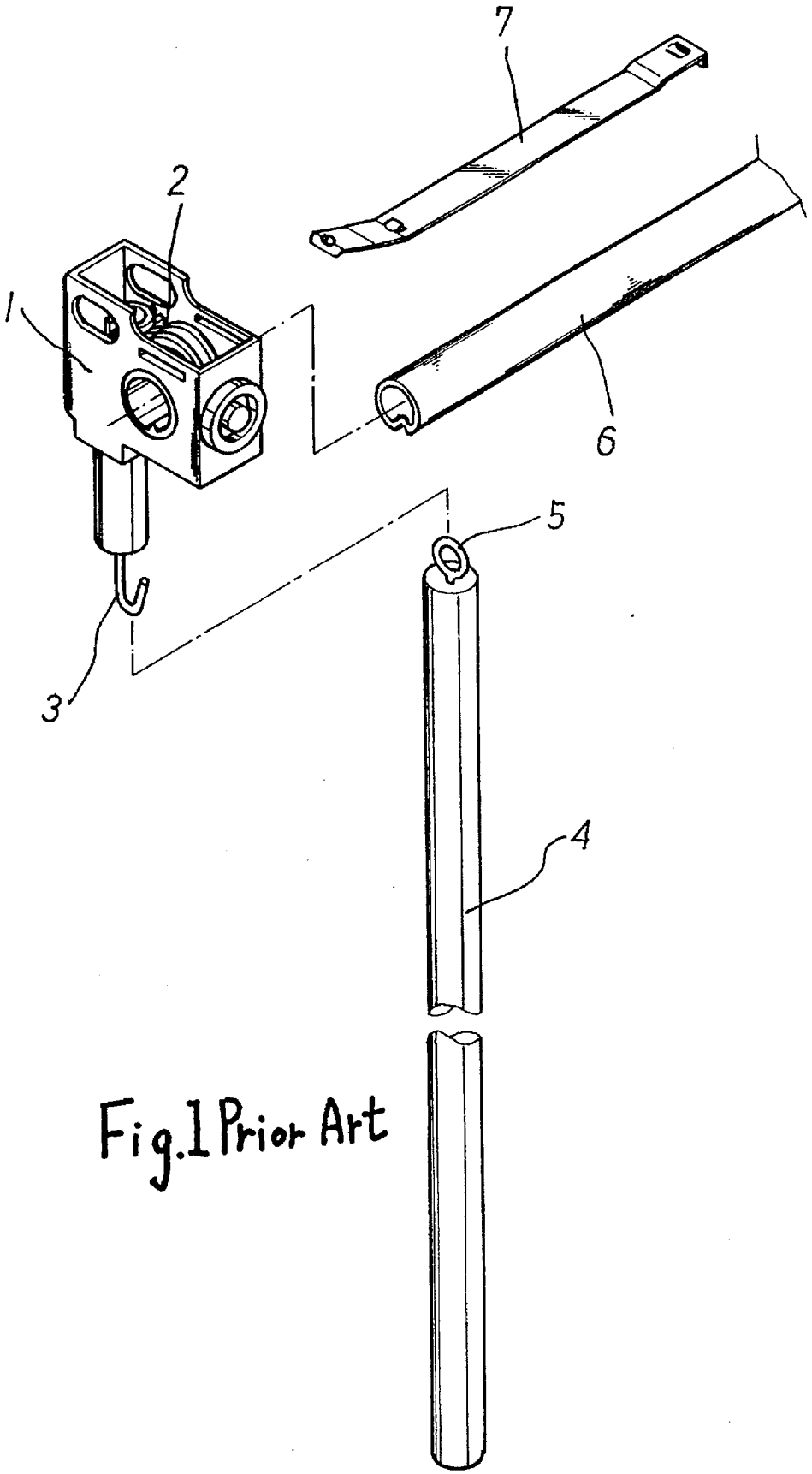
Fig. 1 Prior Art
FIG. 1 is a perspective exploded view of conventional operating structure for a vertical blind.
Figure 2:
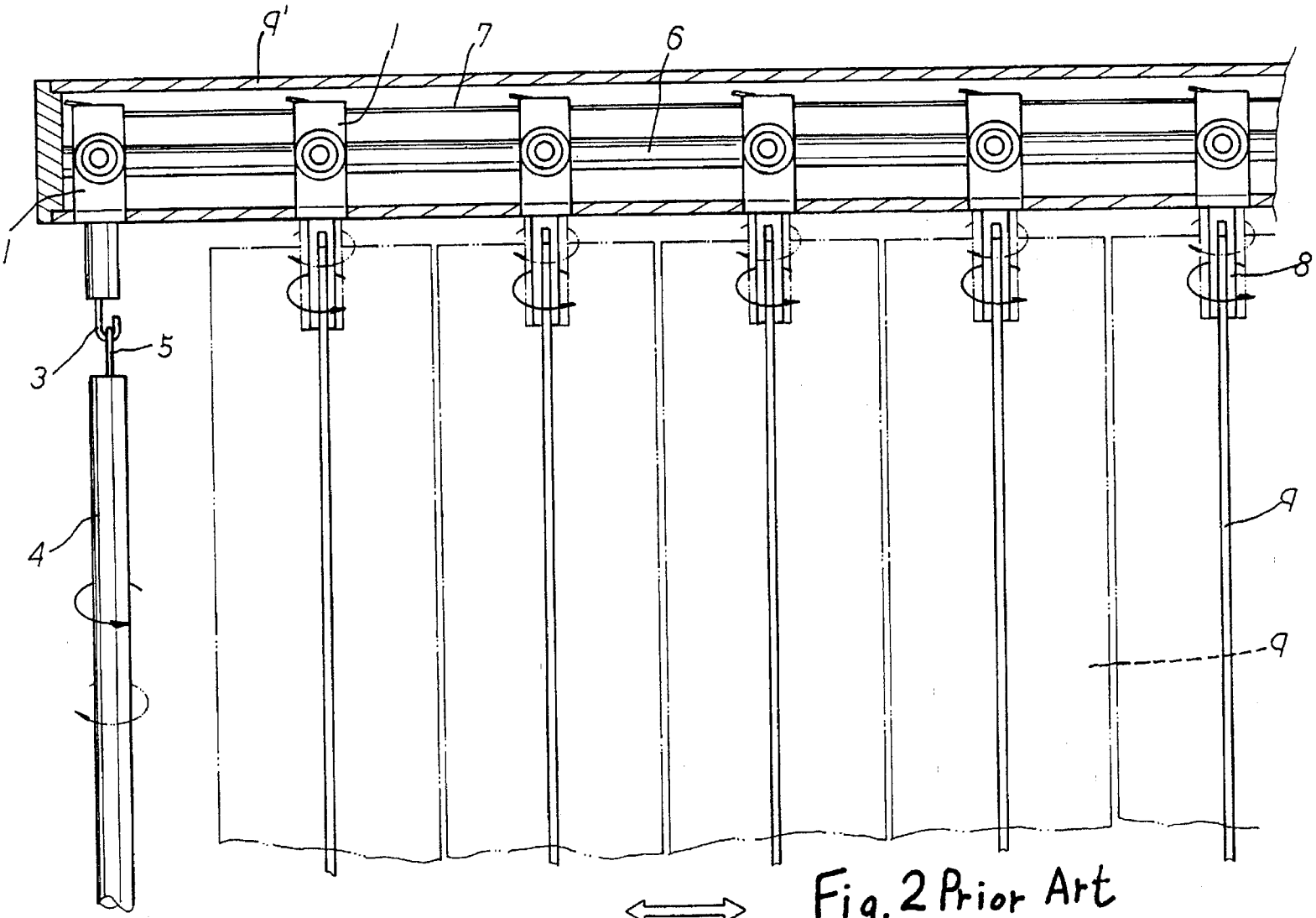
Fig. 2 Prior Art
FIG. 2 is an assembled view of the conventional operating structure, showing the operation thereof.
Figure 3:
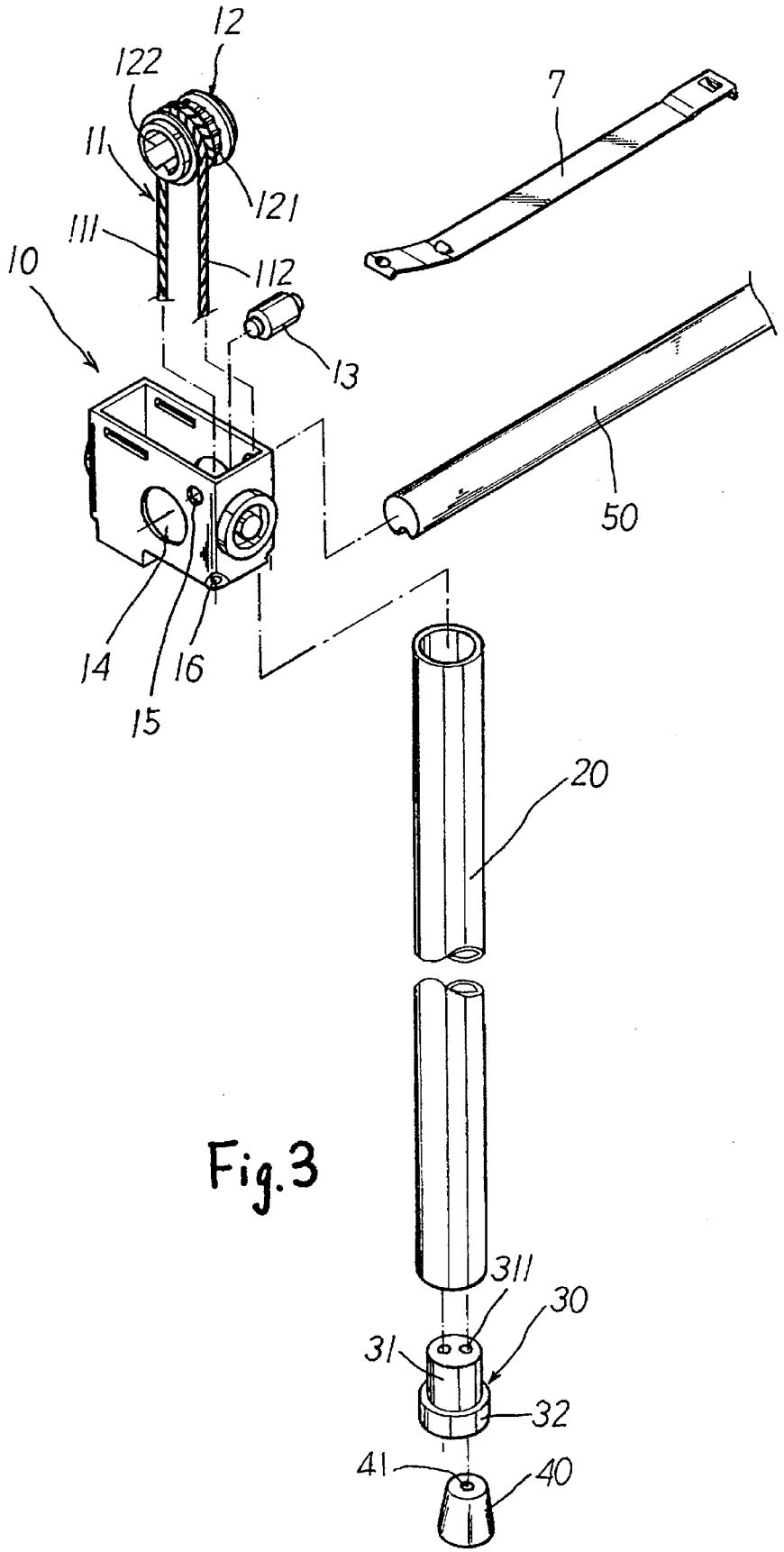
FIG. 3 is a perspective exploded view of the present invention.

Please refer to FIG. 3. The present invention mainly includes an operative pulley seat 10, a guide cord 11, a shaft wheel 12, a pressing wheel 13, a hollow pull rod 20, a stepped fixing block 30, a stopper block 40, a rotary bar 50 and a distance-adjusting strip 7. A pair of shaft wheel holes 14 and a pair of pressing wheel holes 15 are respectively disposed on a left and a right sides of the operative pulley seat 10. Two corner holes 16 are formed on two corners contained by the front side and bottom side of the operative pulley seat 10. The shaft wheel 12 is formed with spaced axial frictional ribs 121 on the surface and a central rotary bar hole 122. The pressing wheel 13 has a large diameter middle section and two small diameter end sections. The pull rod 29 is a hollow cylindrical column with a certain length. The stepped fixing block 39 has a small diameter upper section 31 and large diameter lower section 32. Two through holes 311 extend from the top face of the upper section 31 to the bottom face of the lower section 32. The stopper block 40 is a hollow trapezoidal block having a close top end formed with a cord hole 41 and an open bottom end. The rotary bar 59 is a solid bar made of plastic material, having a shape corresponding to that of the rotary bar hole 122 of the shaft wheel 12.

Figure 4:
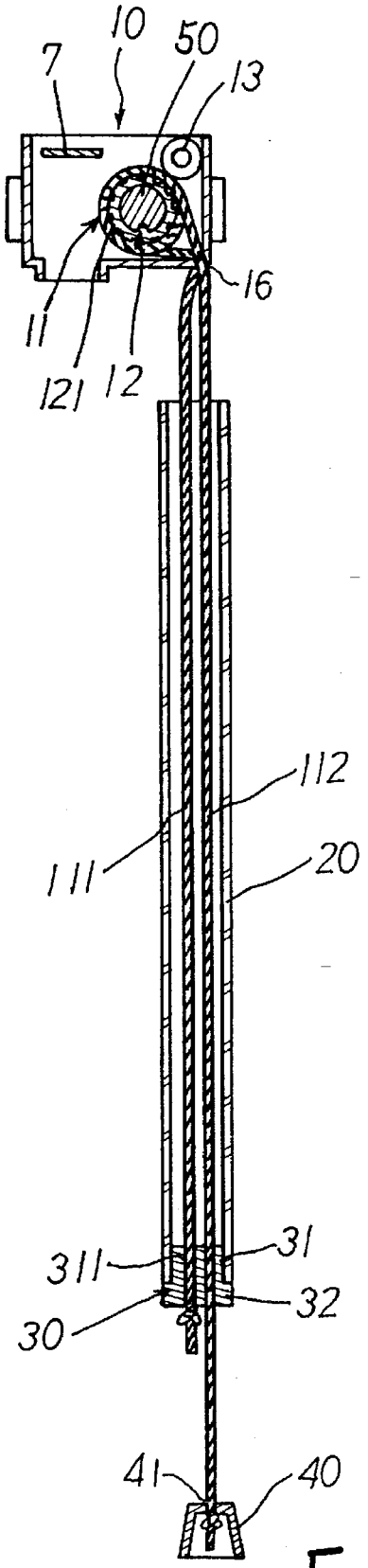
FIG. 4 is a side sectional assembled view of the present invention.

Please refer to FIG. 4. When assembled, the guide cord 11 is wound on the frictional ribs 121 of the surface of the shaft wheel 12 and then the two ends of the shaft wheel 12 are rotatably fitted into the shaft wheel holes 14 of the pulley seat 10. A first and a second end sections 111, 112 of the guide cord 11 are then passed through the corner holes 16 of the pulley seat 10, the hollow pull rod 20 and the through holes 311 of the stepped fixing block 39. Thereafter, the first end section 111 of the guide cord 11 is knotted and prevented from being withdrawn from the through hole 311, while the second end section 112 is further passed through the cord hole 41 of the stopper block 40 and knotted and thus prevented from being withdrawn from the cord hole 41.

Then the periphery of the upper section 31 of the fixing block 30 is painted with an adhesive and plugged into the lower end of the hollow pull rod 20. Then the two ends of the pressing wheel 13 are rotatably fitted into the pressing wheel holes 15 of the pulley seat 10 with the middle section of the pressing wheel 13 abutting against the guide cord 11 wound on the frictional ribs 121 of the shaft wheel 12 so as to prevent the guide cord 11 from loosening from the shaft wheel 12 during operation. Then the rotary bar 50 is passed through the rotary bar hole 122 of the shaft wheel 12 and the distance adjusting strip 7 is fitted into the distance adjusting slots formed on lateral walls of the pulley seat 10.

Figure 5:
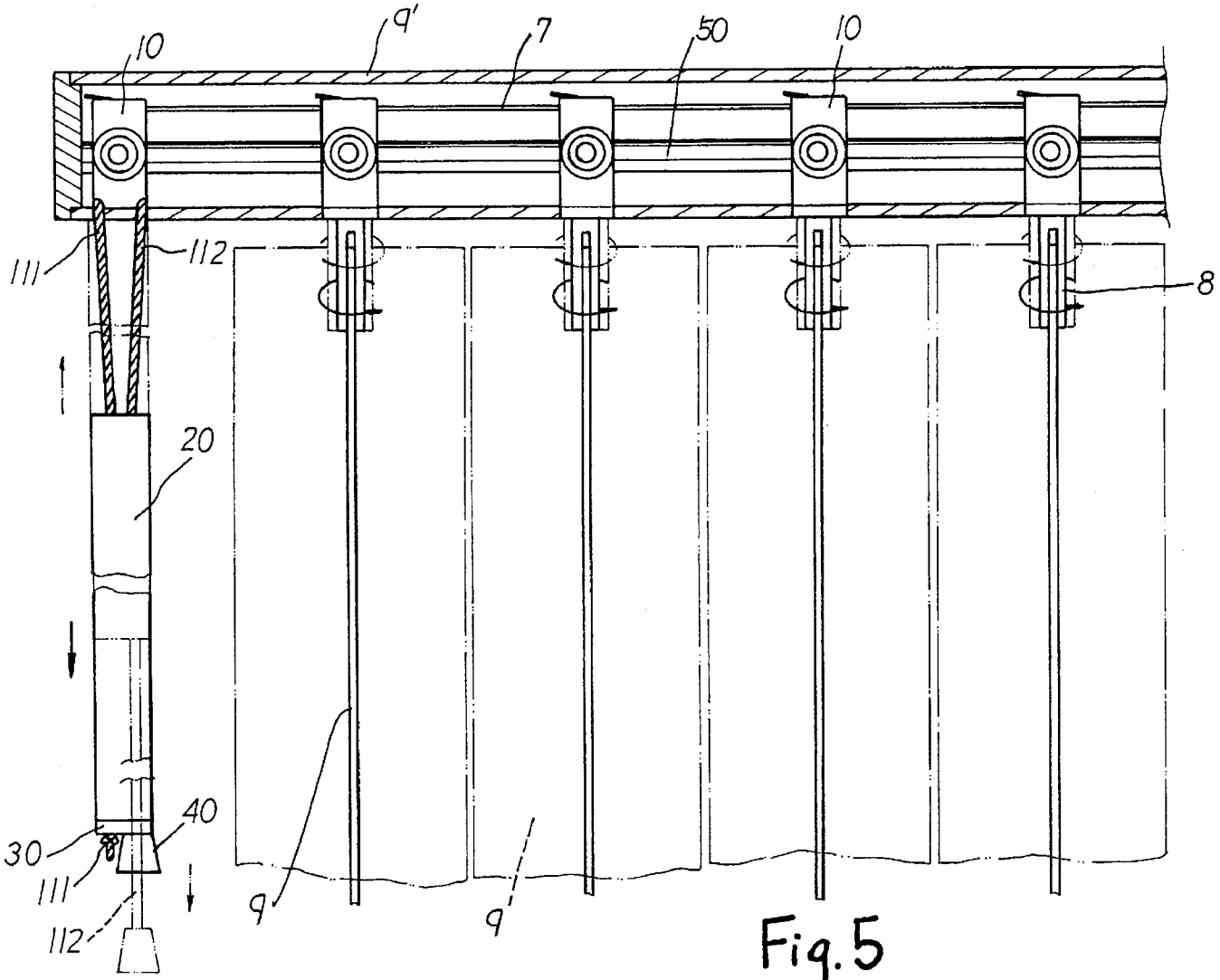
FIG. 5 is an assembled view of the present invention, showing the adjustment of the angle of the slats.

Please refer to FIG. 5. The angle of the slats 9 is adjusted for achieving best light (with each slat 9 facing the other) in such a manner that the hollow pull rod 20 is first pulled downward, making the first end section 111 of the guide cord 11 simultaneously pulled downward until the bottom face of the fixing block 30 abuts against the top face of the stopper block 49. At this time, the shaft wheel 12 is rotarily driven by the first end section 111 of the guide cord 11 and the rotary bar 50 is in turn rotarily driven by the shaft wheel 12. Then the rotary bar 50 rotarily drives the slats 9 clipped by the clip members 8 of all other pulley seats 10 to a face-to-face position perpendicular to the window as shown by solid lines. On the other hand, the angle of the slats 9 can be adjusted for achieving best shading effect in such a manner that the stopper block 40 is pulled downward, making the second end section 112 of the guide cord 11 simultaneously pulled downward with the hollow pull rod 20 pulled upward by the first end section 111 until the top face of the pull rod 20 abuts against the bottom face of an upper beam 9'. At this time, the shaft wheel 12 is reversely rotated and the rotary bar 50 is driven and reversely rotated by the shaft wheel 12 so as to rotarily drive the slats 9 clipped by the clip members 8 of all other pulley seats 10 to a side by side position parallel to the window as shown by the phantom lines.

Figure 6:
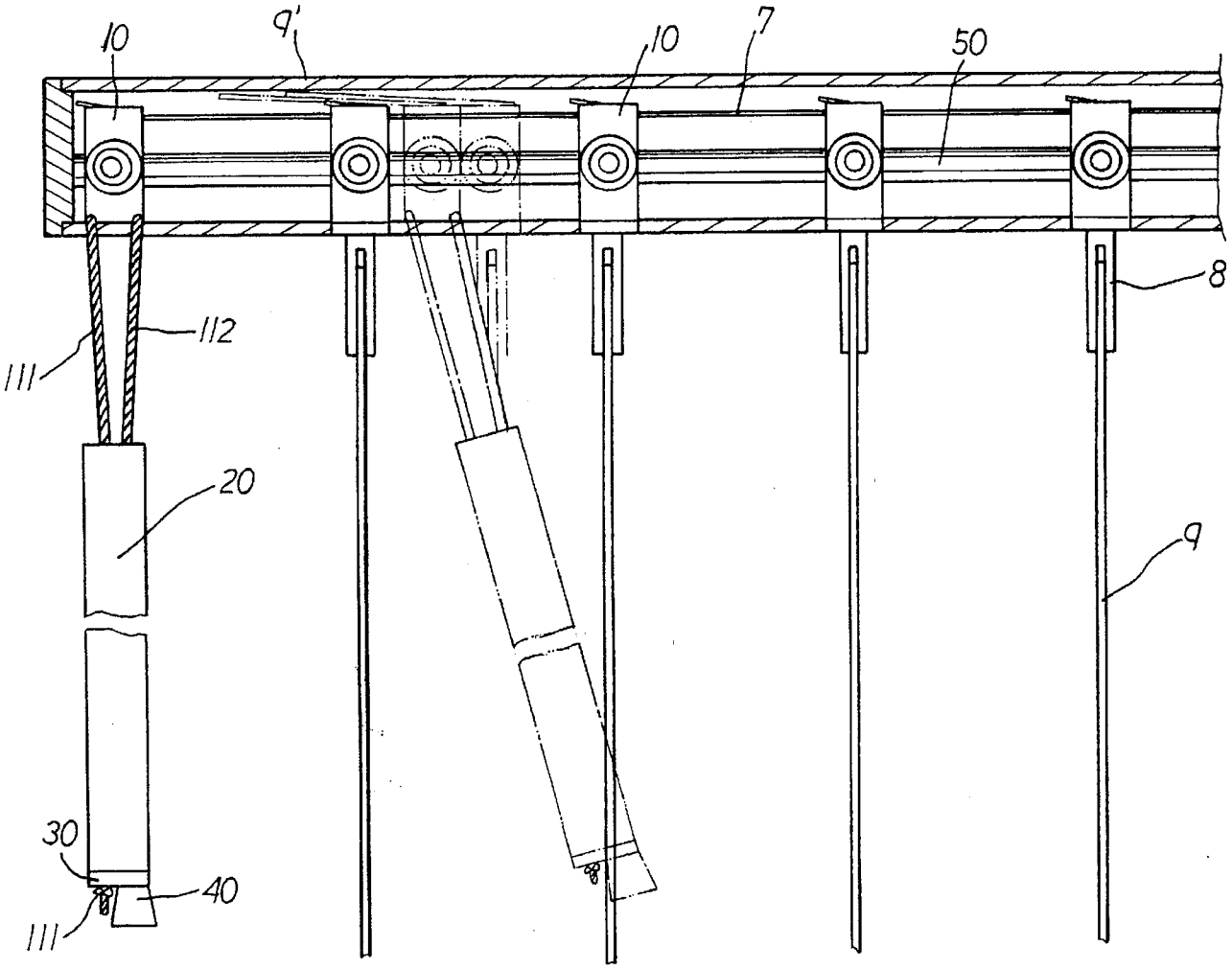
FIG. 6 is an assembled view of the present invention, showing the collection of the slats.

Please refer to FIG. 6. The slats 9 can be collected in such a manner that the hollow pull rod 20 is held and pulled in a collecting direction so as to rotarily drive the shaft wheel 12 and simultaneously rotarily drive the rotary bar 50. At this time, the slats 9 clipped by the clip members 8 of all other pulley seats 10 are automatically rotated by the rotary bar 50 to a face-to-face position and collected.

By means of the above arrangements, the slats 9 of the blind can be easily collected without being damaged even in the case that the slats are not face-to-face positioned. In addition, the angle of the slats can be easily adjusted to open or close the blind.

The above embodiment is only an example of the present invention and the scope of the present invention should not be limited to the example. Any modification or variation derived from the example should fall within the scope of the present invention.

What is claimed is:

1. An operating structure for a vertical blind, comprising an operative pulley seat, a guide cord, a shaft wheel, a pressing wheel, a hollow pull rod, a stepped fixing block, a stopper block, a rotary bar and a distance-adjusting strip, said operative pulley seat having a right side, a left side, a bottom side and a front side, a pair of shaft wheel holes and a pair of pressing wheel holes being respectively disposed on the left side and the right side of the operative pulley seat, the shaft wheel being formed with a central rotary bar hole, the rotary bar having a shape corresponding to that of the rotary bar hole and being passed therethrough, the distance adjusting strip being fitted into two distance adjusting slots on the operative pulley seat, said operating structure being characterized in that:

two corner holes are formed on two corners formed by the front side and the bottom side of the operative pulley seat;

the shaft wheel is formed with spaced axial frictional ribs;

the pressing wheel has a large diameter middle section and two small diameter end sections;

the pull rod is a hollow cylindrical column with a certain length;

the stepped fixing block has a small diameter upper section and a large diameter lower section, two through holes extending from top face of the upper section to bottom face of the lower section; and the stopper block has a closed top end formed with a cord hole and an open bottom end, whereby the guide cord is wound on the frictional ribs of the shaft wheel and then the two ends of the shaft wheel are rotatably fitted into the shaft wheel holes of the pulley seat, a first and a second end sections of the guide cord being then passed through the corner holes of the pulley seat, the hollow pull rod and the through holes of the stepped fixing block, the first end section of the guide cord being knotted and prevented from being withdrawn from the through hole, while the second end section being further passed through the cord hole of the stopper block and knotted and thus prevented from being withdrawn from the cord hole, then a periphery of the upper section of the fixing block being painted with an adhesive and plugged into a lower end of the hollow pull rod, the two ends of the pressing wheel being rotatably fitted into the pressing wheel holes of the pulley seat with the middle section of the pressing wheel abutting against the guide cord wound on the frictional ribs of the shaft wheel so as to prevent the guide cord from loosening from the shaft wheel during operation.

* * * * *